United States Patent [19]

Stachowiak

[11] Patent Number: 4,878,815

[45] Date of Patent: Nov. 7, 1989

[54] HIGH PRESSURE RECIPROCATING PUMP APPARATUS

[76] Inventor: J. Edward Stachowiak, P.O. Box 79731, Houston, Tex. 77024

[21] Appl. No.: 195,689

[22] Filed: May 18, 1988

[51] Int. Cl.[4] ..... F04B 21/02; F16J 10/02; F16J 15/24; F16K 15/00

[52] U.S. Cl. ..... 417/63; 417/454; 417/539; 417/567; 417/571; 92/171.1; 137/454.4; 137/512.3; 137/884; 277/115; 277/124; 277/125

[58] Field of Search ..... 417/63, 454, 539, 567, 417/569–571; 137/454.4, 512.3, 884; 277/110, 115, 123–125, 188 A; 92/171

[56] References Cited

U.S. PATENT DOCUMENTS

| | | | |
|---|---|---|---|
| 1,015,685 | 1/1912 | Kahle | 277/115 |
| 1,529,911 | 3/1925 | Norling | 92/171 |
| 2,236,370 | 3/1941 | Jackman | 277/115 |
| 2,292,543 | 8/1942 | Patterson | 277/110 |
| 3,048,412 | 8/1962 | Baker | 277/115 |
| 3,106,169 | 10/1963 | Prosser et al. | 417/567 |
| 3,210,087 | 10/1965 | Mayer | 277/125 |
| 3,373,695 | 3/1968 | Yohpe | 417/454 |
| 3,427,988 | 2/1969 | Redman et al. | 417/569 |
| 3,746,483 | 7/1973 | Hindel et al. | 137/512.3 |
| 3,914,752 | 10/1975 | Howard et al. | 417/63 |
| 4,032,263 | 6/1977 | Pareja | 417/539 |
| 4,333,729 | 6/1982 | Marugg | 417/454 |
| 4,400,144 | 8/1983 | Drutchas et al. | 92/171 |
| 4,758,135 | 7/1988 | Woodward et al. | 417/571 |
| 4,773,833 | 9/1988 | Wilkinson et al. | 417/539 |

*Primary Examiner*—John J. Vrablik
*Attorney, Agent, or Firm*—Neal J. Mosely

[57] ABSTRACT

A high pressure reciprocating pump has a flange plate or mounting plate secured to the plunger end of a pump drive housing and a suction and discharge manifold is hingedly connected thereto. A stuffing box in bores in the flange plate has a central bore receiving one end of the plunger and forming a plunger pressure chamber coaxial with the plunger. A tapered packing assembly in the stuffing box surrounds the plunger in reciprocal sealing relation. A suction and discharge valve cartridge in one or more valve cavities in the manifold block is coaxial with the plunger. The hinged connection clamps the stuffing box in the flange plate for pivotal movement permitting clear access to the stuffing box and the valve cartridges whereby either may be removed as a unit for easy field maintenance. The valve cartridge comprises a common seat member with a suction valve and a discharge valve movably mounted thereon coaxial with the plunger and positioned concentric and radially spaced on the seat. When assembled, the valve cartridge is mechanically biased in the cavity by the stuffing box. The seat member has seals positioned to seal the cavity and the stuffing box around the pressure chamber. The seals are sized and positioned such that the valve cartridge is hydrostatically biased and urged toward the stuffing box by fluid pressure during operation of the pump plunger.

43 Claims, 14 Drawing Sheets

HIGH PRESSURE RECIPROCATING PUMP APPARATUS

BACKGROUND OF THE INVENTION

1. Field of the Invention

This invention relates generally to high pressure reciprocating pumps of the type used in high pressure waterjet applications, and more particularly to an improved high pressure reciprocating pump and manifold, stuffing box, plunger packing, and valve components therefor.

2. Description of the Prior Art

High pressure reciprocating pumps, such as those utilized in high pressure waterjet cleaning and cutting and hydrostatic testing, are often required to produce fluid pressures up to 35,000 psi. Pumps in this type of service commonly require power inputs in excess of 100 horsepower. Because of inherent high cyclic internal pressures and damage caused by impurities in the fluid being pumped, these types of pumps are prone to fatigue failures and require considerable maintenance.

Various prior art pumps intended for high pressure applications are subject to breakage or failure due to excessively high stress concentration at certain points in the pump structure, leakage from the high pressure side of the pump system either to atmosphere or the low pressure side of the system, entrapment of air or gases during operation of the pump, with consequent loss of efficiency and/or hammering, etc.

More specifically, one of the problems encountered with many high pressure pumps arose because of the utilization of pump structure cavities or bores having their axes arranged in relatively angled relationship, for instance at right angles to each other. Thus, in certain high pressure pumps a bore for the pump plunger was arranged at right angles to the bore for certain of the valve structures, resulting in a corner of metal between the right angle bores. This results in an excessive stress concentration at the corner, which causes cracks and failure in the metal, particularly where very high pressures are handled.

The following U.S. Patents disclose pump structures having valve bores arranged at right angles to each other and/or to the pump plunger bore: 4,227,229; 4,432,386; and 3,373,695.

Attempts to reduce the stress concentration have included making the valve housing of hard alloy material which are expensive and difficult to machine, or rounding or chamfering of the corners where stress concentration occurs. This remedy becomes less desirable at very high pressures because of the progressively smaller diameter bores used for the high pressures, resulting in increased difficulty to access to the corners for the necessary machining to round or chamfer the corners.

Other attempts at reducing the stress concentration include arranging the valve mechanisms coaxially of and mounting them to move in directions generally parallel to the motion of the pump plunger in its operating cylinder. Many pumps of this type have the disadvantage of poor suction conditions, low volumetric efficiency, and exposure of the seals to cyclic pressures.

The following U.S. Patents disclose pump structures having valve bores arranged coaxially with the pump plunger bore: 4,551,077; 3,372,648; 3,114,326; 3,508,849; 3,709,638; 4,239,463; and 3,370,545.

The present invention is distinguished over the prior art in general, and these patents in particular by a high pressure reciprocating pump having a mounting flange plate secured to the plunger end of the pump drive housing and a suction and discharge manifold is hingedly connected to the mounting flange. A stuffing box in bores in the mounting flange has a central bore which slidably receives one end of the plunger and forms a plunger pressure chamber coaxial with the plunger. A tapered packing assembly in the stuffing box surrounds the plunger in reciprocal sealing relation. A suction and discharge valve cartridge is one or more valve cavities in the manifold block is coaxial with the plunger.

The hinged connection clamps the stuffing box in the mounting flange and allows the manifold pivot for clear access to both the stuffing box and the valve cartridges permitting either to be removed independently of the other for easy field maintenance. The valve cartridge comprises a common seat member having a suction valve and a discharge valve movably mounted coaxial with the plunger and positioned concentric and radially spaced on the seat. When assembled, the valve cartridge is mechanically biased in the cavity by the stuffing box. The seat member has seals positioned to seal the cavity and the stuffing box around the pressure chamber. The seals are sized and positioned such that the valve cartridge is hydrostatically biased and urged toward the stuffing box by the fluid forces acting thereon during operation of the pump plunger.

SUMMARY OF THE INVENTION

It is therefore an object of the present invention to provide a high pressure reciprocating pump capable of producing fluid pressures up to 35,000 psi.

It is another object of this invention to provide a high pressure reciprocating pump which utilizes a common seat for both the suction and discharge valves thus requiring fewer parts and allowing the seat, valves, springs, and all seals to be handled and replaced as a single cartridge.

Another object of this invention is to provide a high pressure reciprocating pump in which the pump fluid end is completely field serviceable in that all components can be easily and quickly replaced.

Another object of this invention is to provide a high pressure reciprocating pump having a hinged manifold block allowing the manifold block to be pivoted for clear access to the valve cartridges and stuffing boxes.

Another object of this invention is to provide a high pressure reciprocating pump with single valve cavities rather than separate cavities for discharge and suction valves in the manifold block.

Another object of this invention is to provide a high pressure reciprocating pump wherein the stuffing boxes may be removed and replaced separately or complete with the plunger, plunger guide bushing, packing, and packing gland as an assembled unit.

Another object of this invention is to provide a high pressure reciprocating pump wherein the stuffing boxes contain a self adjusting tapered packing assembly which allows the packing, plunger, plunger guide bushing, and packing gland to be easily and quickly removed and serviced as a unit.

Another object of this invention is to provide a high pressure reciprocating pump having a clamping stuffing box arrangement which eliminates the need for stuffing box bolts.

Another object of this invention is to provide a high pressure reciprocating pump having a hydraulically biased valve cartridge which does not require close tolerances for the cartridge cavity depth in the manifold block and the length of the cartridge.

Another object of this invention is to provide a high pressure reciprocating pump having a hydraulically biased valve cartridge which provides constant loading of the manifold block bolts to prevent failure of the bolts due to fatigue caused by the high cyclic bolt loading in conventional bolting arrangements.

Another object of this invention is to provide a high pressure reciprocating pump having a hydraulically biased valve cartridge which also serves as a pressure relief valve should potentially dangerous transient pressures occur in the stuffing box chamber.

A further object of this invention is to provide a high pressure reciprocating pump having tell-tale holes which will alert the pump operator of any fluid leakage due to failure of the sealing members so that the pump may be shut down before permanent damage occurs.

A still further object of this invention is to provide a high pressure pump which is simple in design, economical to manufacture, requires fewer parts, and is rugged and reliable in operation.

Other objects of the invention will become apparent from time to time throughout the specification and claims as hereinafter related.

The above noted objects and other objects of the invention are accomplished by a high pressure reciprocating pump having a mounting flange secured to the plunger end of the pump drive housing and a suction and discharge manifold hingedly connected thereto. A stuffing box received in bores in the mounting flange has a central bore slidably receiving one end of the plunger and forming a plunger pressure chamber coaxial with the plunger. A tapered packing assembly in the stuffing box surrounds the plunger in reciprocal sealing relation. A suction and discharge valve cartridge is received in one or more valve cavities in the manifold block coaxial with the plunger.

The hinged connection clamps the stuffing box in the adapter flange and allows the manifold to be moved for clear access to both the stuffing box and the valve cartridges whereby either may be removed as a unit for easy field maintenance. The valve cartridge comprises a common seat member having a suction valve and a discharge valve coaxial with the plunger and positioned concentric and radially spaced on the seat. When assembled, the valve cartridge is mechanically biased in the cavity by the stuffing box and the seat member has seals positioned thereon in sealing engagement with the cavity and the stuffing box around the pressure chamber. The seals are sized and positioned such that the valve cartridge is hydrostatically biased and urged toward the stuffing box by the fluid forces acting thereon during operation of the pump plunger.

DESCRIPTION OF THE PREFERRED EMBODIMENT

Figure 1:
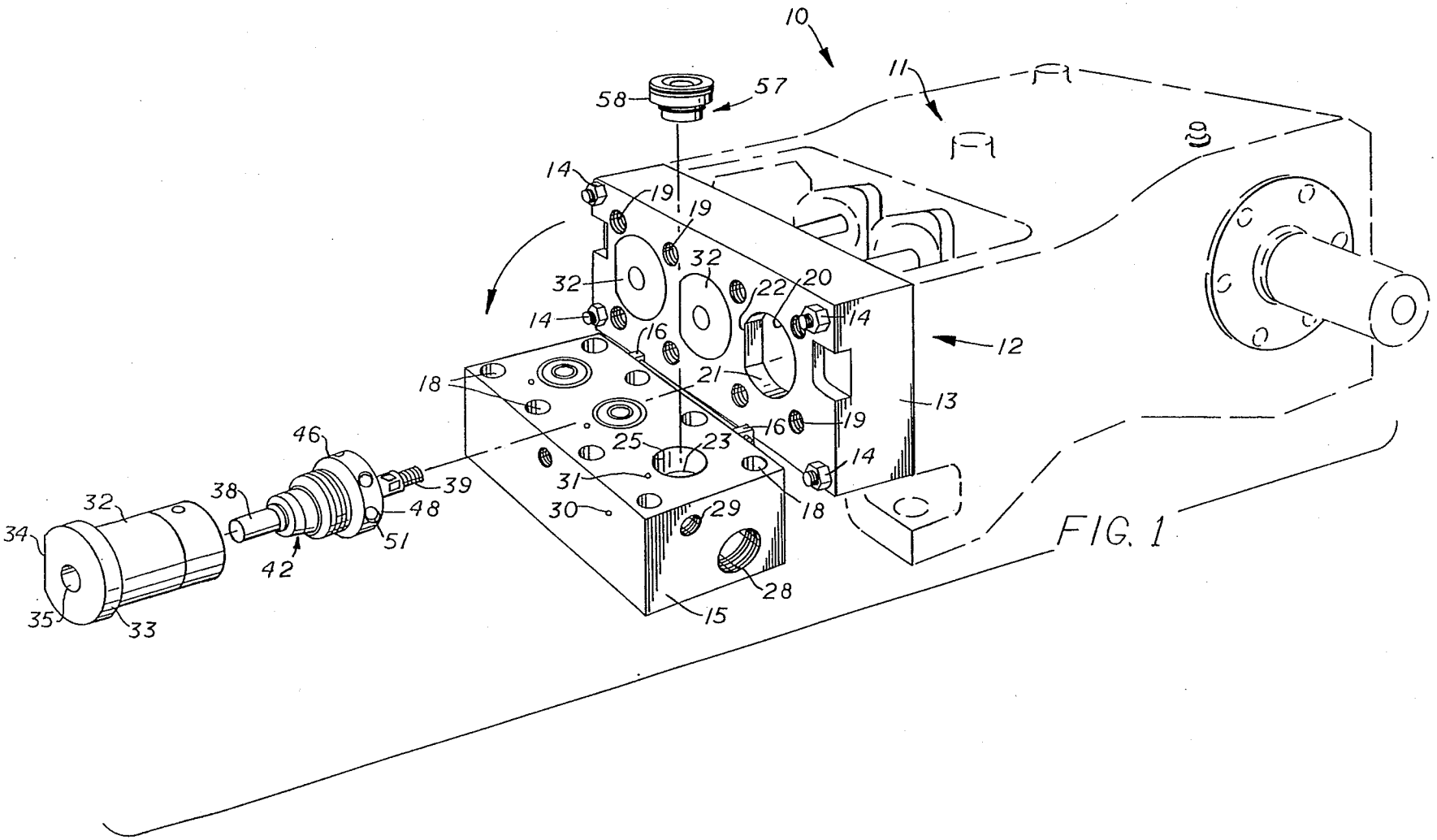
FIG. 1 is a perspective view of a high pressure reciprocating pump having fluid end apparatus in accordance with the present invention.
Figure 2:
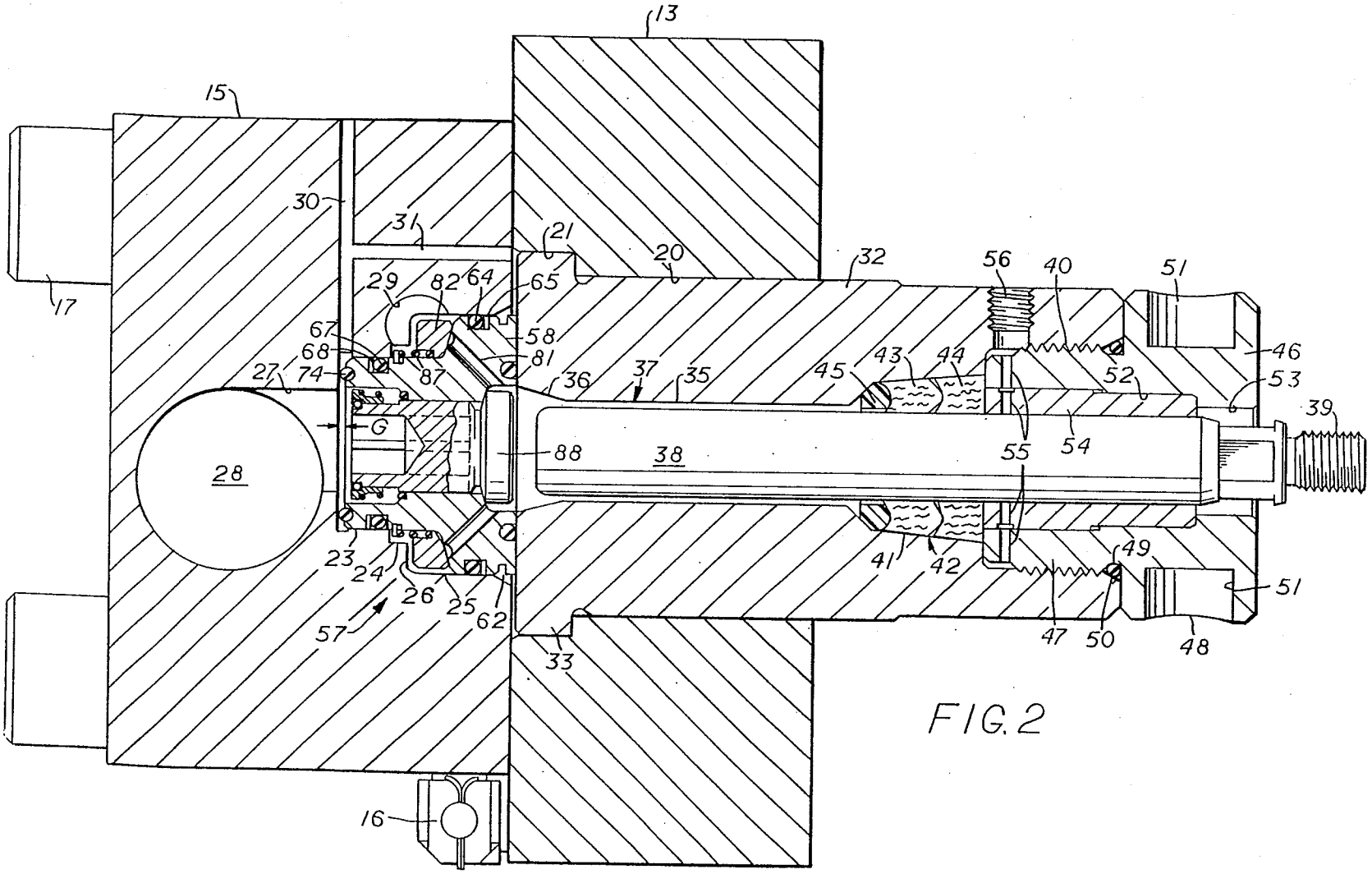
FIG. 2 is a longitudinal cross section through a portion of the fluid end of the high pressure reciprocating pump showing the components of the present invention.
Figure 6:
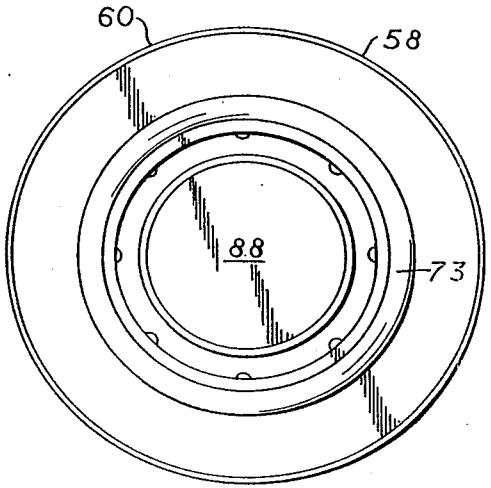
FIG. 6 is an end view of the valve cartridge member.
Figure 4:
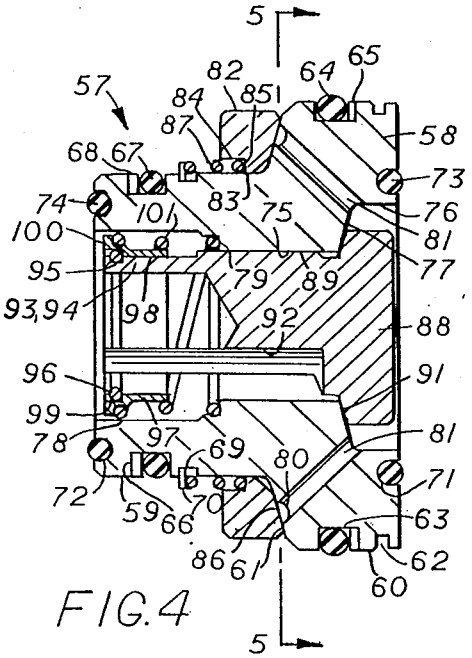
FIG. 4 is a cross section through the valve cartridge member in the assembled condition.
Figure 5:
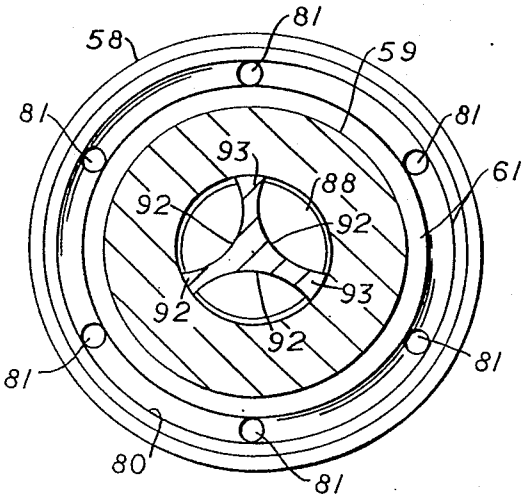
FIG. 5 is a transverse cross section of the valve cartridge member taken along line 5—5 of FIG. 4.
Figure 3:
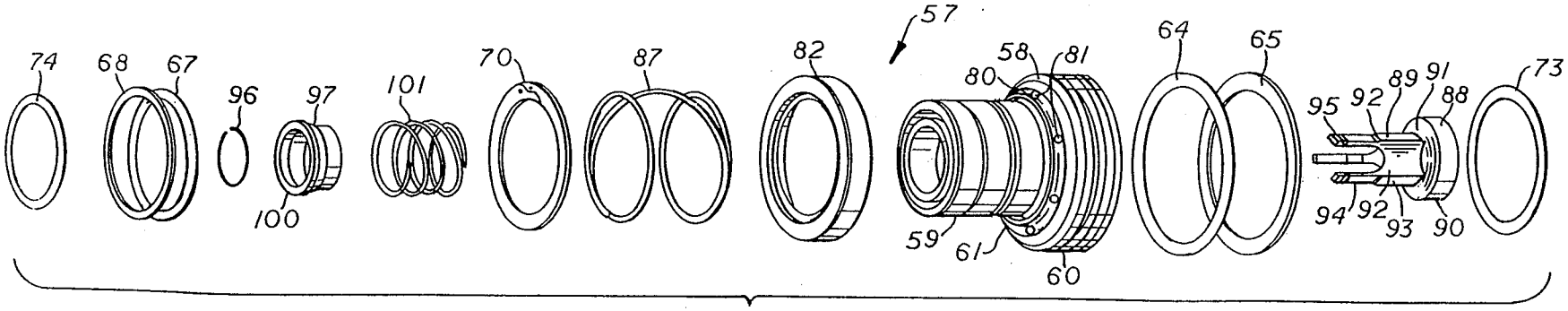
FIG. 3 is a side view of a valve cartridge member of the present invention showing its components in an unassembled condition.

Referring to the drawings by numerals of reference, there is shown in FIGS. 1 and 2, a high pressure reciprocating pump 10 including a drive housing 11 and a pump fluid end 12. A rectangular mounting plate or flange plate 13 is bolted to the pump power end 12 by bolts 14. A generally rectangular manifold block 15 is connected to the flange plate 13 by hinges 16 along the adjacent bottom edges of the members 13 and 15. Manifold bolts 17 extend through holes 18 in the manifold block 15 and are threadedly received in threaded holes 19 in the outer surface of the flange plate 13 to secure the manifold to the flange plate. Thus the flange plate 13 serves as a bolting plate to which the manifold block 15 is attached to the pump and provides the means by which the fluid end is mounted to the pump power end.

The preferred flange plate material is mild steel or other suitable low cost material of sufficient strength to withstand the requirements of the manifold block bolt threads. The manifold block material may have lower strength characteristics than fluid blocks of conventional valve designs because of the absence of high cyclic pressures within its passages. The use of lower fatigue strength materials provides a cost saving over materials with higher fatigue strength.

Cylindrical bores 20 extend through the flange plate 13 and are counterbored 21 a distance inward from the outer surface of the flange plate. Each counterbore 21 has a flat surface 22 along one side. Cylindrical bores 23 extend inwardly from one surface of the manifold block 15, each having a larger diameter intermediate bore 24 and being counterbored at 25 from the outer surface of the manifold plate 15 to define a shoulder 26. Each bore 23 and 24 and counterbore 25 is axially aligned with bores 20 of the flange plate 13.

A cylindrical passage 27 extends axially from each bore 23 in fluid communication with a cylindrical suction port 28 which extends longitudinally inward from one side surface of the manifold block 15. A smaller diameter discharge port 29 extends longitudinally inward from one side surface of the manifold block 15 and is in communication with counterbore 25 at the location of the shoulder 26. A small bore or tell-tale hole 30 extends from each bore 23 to one side of the manifold block 15 and another tell-tale hole 31 in communication therewith extends perpendicularly to the inward surface of the manifold block 15 at the location of the counterbore 21 in the flange plate 13.

A cylindrical stuffing box 32 is slidably received and contained within each bore 20 of the flange plate 13. Each stuffing box 32 has a circumferential flange 33 at one end which has a flat surface 34 along one side corresponding to the flat surface 22 of the counterbore 21 in the flange plate 13. The stuffing box flange 33 retains the stuffing box 32 in the flange plate 13 during operation with the flat 34 preventing stuffing box 32 from rotating.

A central longitudinal bore 35 extends through the stuffing box 32 and is tapered 36 at the flanged end to form a pump chamber 37 slidably receiving one end of a cylindrical plunger 38. The opposite end of the plunger 38 has threads 39 for connection to a conventional pump power end crosshead stub or pony rod (not shown). Alternatively, the plunger connection may be a conventional flange and yoke connection (not shown). The inward end of the stuffing box (toward the pump drive housing) has an internally threaded diameter 40 and an inwardly tapered packing bore 41 extending between the threaded portion 40 and the central bore 35.

A plunger packing assembly 42 in the tapered bore 41 comprises one or more chevron packing rings 43, a chevron adapter ring 44 at one end, and a retainer ring 45 at the other end. The outside diameter of the packing assembly 42 is tapered at approximately 5° relative to the longitudinal axis. The preferred retainer ring 45 is made from metal or hard plastic and prevents any fragments which may come off the packing rings as the packing wears from entering fluid being pumped.

A packing gland 46 is received in the threaded end 40 of the stuffing box 32. The packing gland 46 comprises a generally cup-shaped cylindrical member having an externally threaded diameter 47 at one end and an enlarged diameter 48 at the other end, with an O-ring groove 49 having an O-ring seal 50. One or more circumferentially spaced flat bottom holes 51 in the enlarged diameter 48 of the gland 46 are sockets for insertion of round bar, or one end of a hex key wrench (which may be the same as used on manifold block bolts) to act as a lever to tighten or remove the gland. An internal bore 52 extends from the threaded end and terminates in a smaller diameter bore 53.

A hollow cylindrical plunger guide bushing 54 in bore 52 guides the plunger 38 through packing assembly 42 and acts as a backup for the packing adapter ring 44. Guide bushing 54 is preferably of bearing quality brass or bronze. One or more lubricating holes or ports 55 extend transversely through the side wall of both the threaded diameter 47 of the gland 46 and the bushing 54 in axial alignment. A threaded hole 56 through the side wall of the stuffing box 32 communicates with lubricating ports 55 to connect a packing lubrication system to the stuffing box 32. Suitable packing lubrication may be oil, grease, or water. Lubrication fluid flows through the ports 55 in the gland 46 and guide bushing 54 and on to the plunger 38. O-ring 50 prevents lubrication fluid from leaking through the gland threads 47. Stuffing box flange 33 retains stuffing box 32 in the flange plate 13 during operation with the flat 34 preventing the stuffing box from rotating when the packing gland is screwed in or out.

The tapered outer diameter of the packing assembly 42 facilitates installation and removal of the packing assembly, prevents the packing from traveling forward with the plunger 38 on its discharge stroke, and allows the packing to retain the plunger guide bushing 54 on the plunger discharge stroke. Tests have shown that the tapered configuration of the packing rings provides the packing assembly 42 with a self-adjusting feature because fluid pressure on the packing assembly during the plunger discharge stroke tends to continually re-form the packing into the larger end of the tapered cavity 41 to compensate for the wear on the packing.

Thus, the tapered outside diameter on the packing rings eliminates the need for a spring which used conventionally to spring load the packing for wear compensation purposes. Packing assembly 42 is easily removed for replacement by dis-connecting plunger 38 from the power end crosshead stub or pony rod, unscrewing gland 46 from stuffing box 32, and removing gland 46, plunger 38, plunger guide bushing 54, and packing assembly 42 as a single unit (FIG. 1).

Referring to FIGS. 2–6, a valve cartridge assembly 57 is slidably received with each bore 23 and counterbore 25 of the manifold block 15. The valve cartridge assembly 57 comprises a generally cylindrical seat member 58, the exterior of which has a first or smaller diameter 59 at one end, a larger diameter 60 at the other end, and an outwardly tapered shoulder, or valve seat surface 61. The tapered shoulder forms the seating surface for the discharge valve (explained hereinafter). Although the seating surface 61 of the discharge valve may be at various angles, the preferred angle is 74° relative to the longitudinal axis of the bore 75 in the seat 58.

A circumferential groove 62 near the end of the larger diameter 60 facilitates removal of the seat 57 as by prying the cartridge out of the manifold block cavity with two screwdrivers. An O-ring groove 63 between the groove 62 and the tapered shoulder 61 contains an O-ring 64 and a backup ring 65. An O-ring groove 66 near the end of the smaller diameter 59 contains an O-ring 67 and a backup ring 68. A circumferential snap ring groove 69 in the smaller diameter 59 between the O-ring groove 66 and the tapered shoulder 61 receives a snap ring 70. Each end face of seat member 57 has an O-ring groove 71 and 72 receiving O-rings 73 and 74 respectively.

The interior of seat member 58 has a central longitudinal bore 75 counterbored 76 at the larger diameter end to define a spherical seating surface 77. While a spherical seating surface is illustrated, it should be understood that that seating surface 77 may also be tapered or flat. Another counterbore 78 in the smaller diameter end of seat member 58 defines a small shoulder 79 between counterbore 76 and central bore 75. A concave groove 80 is formed in the tapered shoulder 61 and a plurality of small passageways 81 extend from the groove 80 to the counterbore 76. The groove 80 and passageways 81 form the flow path for the discharge fluid.

A discharge valve 82 is slidably mounted on the smaller exterior diameter 59 of the seat 58. Discharge valve 82 is a ring-shaped member with a central bore 83 and counterbore 84 defining a flat shoulder 85. The exterior diameter of discharge valve 82 is smaller than counterbore 25 in manifold block 15 to form an annulus or gap therebetween. The end surface of discharge valve 82 opposite counterbore 84 is tapered to form a sealing surface 86 corresponding to tapered seating surface 61 of seat 58 to form a fluid sealing relation therewith.

A compression spring 87 on the smaller exterior diameter 59 of seat 58 has one end against shoulder 85 in discharge valve 82 and its other end against snap ring 70 to urge the discharge valve to its closed position on seating surface 61. A suction valve member 88 is slidably contained within the interior bore 75 of valve seat 58. Suction valve member 88 comprises a generally cylindrical member with a first or smaller diameter portion 89 having an enlarged diameter 90 at one end and a spherical shoulder 91. It should be understood that while a spherical shoulder is shown, a tapered or flat surface may also be utilized. A preferred tapered shoulder would be tapered 45° to 75° degrees relative to the longitudinal valve axis.

Spherical (or tapered) shoulder 91 provides a metal-to-metal seal against the complimentary spherical or tapered shoulder 77 (seating surface) of seat member 58. The enlarged diameter 90 of suction valve member 88 is smaller in diameter than counterbore 76 in seat 57 to provide an annular fluid flow path therebetween in communication with discharge passageways 81. The circumference of smaller diameter portion 89 has longitudinally extending inwardly curved portions 92 which define longitudinal suction fluid flow paths with circumferentially spaced guide wings 93. The inwardly curved side wall portions are cut away a distance inwardly from the end of the guide wing portion to form outwardly extending circumferentially spaced fingers 94. A snap ring groove 95 in the circumference of fingers 94 near their ends receives a snap ring 96.

A spring retaining ring 97 is slidably received on the outer diameter of fingers 94. Spring retaining ring 97 comprises a thin cylindrical member having a central bore 98 and a counterbore 99 at one end. The exterior of retaining ring 97 has a circumferential flange 100 at the counterbored end. Snap ring 96 is received in counterbore 99 and prevents retaining ring 97 from slipping off the end of fingers 94. A compression spring 101 surrounds fingers 94 and is captured between flange 100 of spring retaining ring 97 and shoulder 79 in seat member 58 to normally urge suction valve 88 to the closed position with spherical (or tapered) surface 91 against spherical or tapered shoulder 77.

Thus, suction valve 88 is slidably contained within valve seat 58 and opens to allow fluid to be drawn from suction port 28 and into stuffing box cavity 37 as plunger 38 moves rearward on the suction stroke. Spring 101 urges suction valve 88 closed when the plunger reaches the end of the suction stroke.

OPERATION

With suction valve 88 closed, plunger 38 begins the return cycle of the discharge stroke. As plunger 38 progresses through the discharge stroke, fluid within stuffing box 32 is pressurized to the pressure level of discharge port 29 and acts through discharge flow holes 81 in seat 58 to open discharge valve 82. Further progression of plunger 38 through the discharge stroke forces fluid out of stuffing box cavity 37, through discharge holes 81, past the opened discharge valve 82 and into discharge port 29. At the end of the plunger discharge stroke, discharge valve spring 87 closes discharge valve 82. The discharge valve spring 87 bearing against snap ring 70 biases the discharge valve toward its closed position.

O-ring 73 in the face of seat 58 provides a seal which prevents the fluid in the stuffing box chamber (cavity 37) from leaking past the stuffing box face. O-ring seals 64 and 67 on the outer diameter of seat 58 prevent discharge fluid from leaking past the outside diameters of the seat. Seal backup rings 65 and 68 prevent O-ring seals 64 and 67 respectively from extruding through diametric clearances between the outer diameters of seat 58 and their complimentary bores 23 and 25 in manifold block 15.

O-ring seal 74 seals against fluid in suction port 28 and also prevents any possible leakage past O-ring seal 67 and backup ring 68 from entering suction port 28. Telltale holes 30 and 31 in manifold block 15 alert the pump operator of fluid leakage past any of the valve cartridge O-ring seals which may become damaged. Valve cartridge 57 may be retained within the manifold block by; (1) mechanically clamping it in the manifold block by means of the stuffing box, (2) pressure biasing it against the stuffing box, or (3) both mechanically clamping and pressure biasing it against the stuffing box.

For pressure biasing, the diameters of O-ring seals 64 and 67 are sized to provide a net differential hydraulic area between the two O-ring seals of greater area than the facial area of O-ring seal 73. Fluid pressure in discharge port 29 therefore continuously urges valve cartridge 57 against the stuffing box face and causes O-ring seal 73 to effect a seal on that face. The difference in the differential area of O-ring seals 64 and 67 and the facial area of O-ring seal 73 is approximately 0.20 square inches. The hydraulic biasing force urging valve cartridge 57 against the stuffing box face is approximately 2,000 lbs. When the fluid end discharge pressure is 10,000 psi and the suction pressure is approximately 0 psi.

Figure 7:
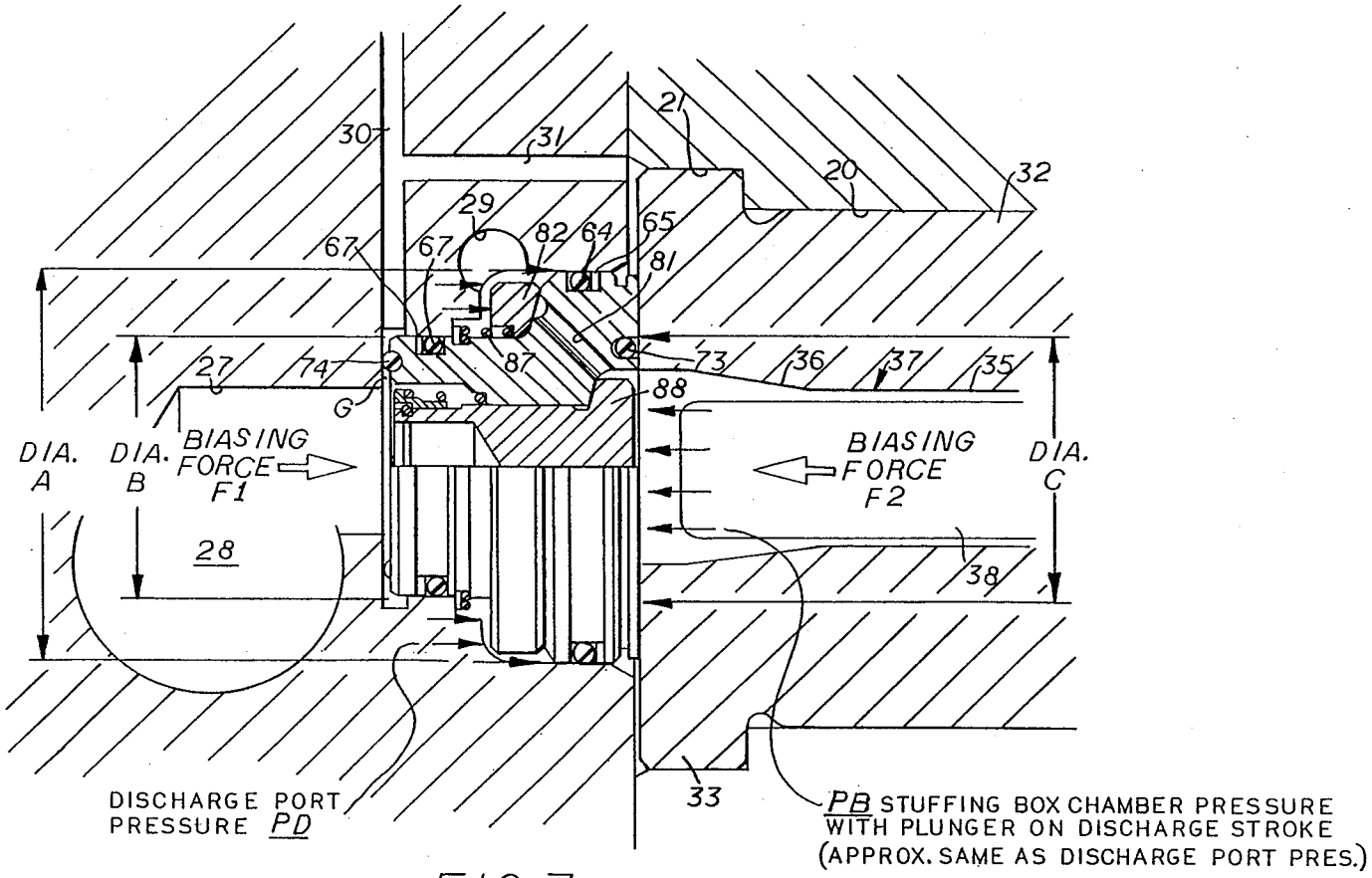
FIG. 7 is a cross section through the fluid end of the high pressure reciprocating pump showing the forces acting on the components in the plunger discharge stroke.

The hydraulic biasing feature is best illustrated in FIG. 7. The annular area between diameter A (O-ring seal 64) and diameter B (O-ring seal 67) is greater than the facial area of diameter C (O-ring seal 73). Discharge port pressure PD constantly acts on the annular area between diameters A and B. The stuffing box chamber pressure PB acts on the facial area of diameter C. The biasing force F1 urging the valve cartridge 57 toward stuffing box 32=F1=(differential area of dia. A and B)×discharge port pressure, PD. The biasing force F2 urging the valve cartridge away from the stuffing box 32=F2=(facial area dia. C)×stuffing box pressure, PB.

When plunger 38 in stuffing box chamber 37 is on its suction stroke, the pressure PB in the stuffing box chamber is equal to the suction port pressure PS, or usually near 0 psi. Biasing force F2 during the suction stroke therefore is approximately 0 lbs. Since the biasing force F1 is constant and equal to the discharge pressure PD×the differential annular area of diameters A and B, the valve cartridge is urged toward the stuffing box face with total F1 force.

During the plunger discharge stroke, pressure PB in stuffing box chamber 37 is approximately the same as pressure PD in discharge port 29. Since the diameter C area is smaller than the differential annular area of diameters A and B, F1 is greater than F2 and the valve cartridge is also urged toward the stuffing box face during the plunger discharge stroke. Even though total biasing force by the valve cartridge on the stuffing box face changes between the suction and discharge strokes of the plunger, the total manifold block bolt forces remain constant because of the change in the valve cartridge biasing force acting on the stuffing box face is offset by the stuffing box chamber pressure force acting on the stuffing box face.

As mentioned above, the valve cartridge hydraulic biasing feature offers several advantages. First, mechanical clamping of the cartridge requires that a precise depth be held on the valve cartridge cavity which is machined into the manifold block. Mechanical clamping also requires that the valve cartridge length be precisely held. Manufacturing costs are higher with the mechanical clamping design because of the need to maintain the precise dimensions.

However, in the hydraulically biased valve cartridge installation, a small gap G may exist between the back of the cartridge (O-ring seal 74 side) and the bottom shoulder of the valve cartridge cavity in the manifold block. Thus, the depth of the cavity and length of the cartridge need only be held close enough to insure that O-ring seal 73 initiates a seal against the stuffing box face. Once this seal is initiated, the hydraulic biasing of the cartridge will effect the final seal of O-ring seal 73. The hydraulically biased valve cartridge installation also allows flange 33 of stuffing box 32 and the depth of complimentary counterbore 21 in flange plate 13 to have looser tolerances than the mechanically clamped valve cartridge installation.

Another advantage of the present hydraulically biased valve cartridge is that it provides constant loading of the manifold block bolts to prevent failure of the bolts due to fatigue caused by the high cyclic bolt loading which is common in conventional bolting arrangements.

Still another advantage of the present hydraulically biased valve cartridge is that if pressure "spikes" or high transient pressure peaks develop in stuffing box chamber 37 due to an insufficient amount of suction fluid, leaking valves, or aerated suction fluid, the pressure spikes will urge valve cartridge 57 away from the stuffing box face. This is because the small biasing area of 0.20 square inches and the resulting biasing force from the discharge port pressure is not large enough to hold the valve cartridge in contact with the stuffing box face.

If the valve cartridge is urged away from the stuffing box face, O-ring seal 73 will fail by extrusion through the gap G between the face of the seat and the stuffing box face and leaking fluid will flow through tell-tale hole 31 and emerge through tell-tale hole 32. The leakage will alert the operator to shut the pump down before permanent fatigue damage from pressure spikes occurs. Thus, the hydraulically biased valve cartridge also serves as a pressure relief valve if potentially dangerous transient pressures occur in the stuffing box chamber.

The valve cartridge design and placement allows higher volumetric efficiency and minimizes the amplitude of pressure peaks in the pressure chamber resulting in less cyclic stresses of the internal pump components. The small pressure chamber clearance volume created by the present valve design provides higher pumping volumetric efficiency because the plunger pressurizes fluid while it is in a low velocity range of its discharge stroke. Conversely, if a smaller amount of fluid were drawn into the pressure chamber and the plunger pressurized the fluid nearer to the mid point of its stroke where its linear velocity is maximum the result would be higher pressure peaks and cyclic stresses would be created.

Placement of the valving between the manifold and the stuffing box prevents high amplitude cyclic pressures created in the stuffing box from acting on the internal passages in the manifold block which would cause fatigue failure of the block. The discharge port in the manifold block is exposed to full discharge pressure but, since it is downstream of the discharge valve, this pressure is relatively constant as compared to stuffing box suction pressure-to-discharge pressure cycles and therefore is not harmful in terms of fatigue to the manifold block.

The O-ring sealing arrangement of the present invention has ideal sealing principles since O-ring seals 64 and 67 are exposed only to constant (discharge) pressures and O-ring seal 73 on the face of the seat is exposed to cyclic stuffing box chamber pressures. Cyclic pressure exposure is detrimental to an O-ring seal in the pressure ranges encountered in high pressure fluid ends, and a metal-to-metal backup condition is preferred on such cyclic pressure seals. The present hydraulic biased valve cartridge design provides this metal-to-metal backup condition for O-ring seal 73 because it insures contact of the face of the seat with the face of stuffing box 32.

O-ring seals 64 and 67 do not have metal-to-metal backup and must seal the small annulus clearance that exists between the outside diameter of the seat 57 and the internal diameter of the valve cartridge cavity. However, this circumferential sealing arrangement is acceptable because these seals are exposed only to constant (discharge port) pressure. Backup rings 65 and 68 are made of a harder and more durable elastomer than O-rings 64 and 67 and are used as anti-extrusion rings to further reduce the possibility of sealing problems from the respective O-rings.

The present pump fluid end is completely field service-able since all components can be easily and quickly replaced. The hinged connection between flange plate 13 and manifold block 15 allows the manifold block to be pivoted down after removal of the manifold bolts to provide clear access to valve cartridges 57 and stuffing boxes 32. The stuffing boxes can be removed and replaced separately or complete with the plunger, plunger guide bushing, packing, and packing gland as an assembled unit.

Valve cartridges 57 are removed by inserting a pair of screwdrivers or other suitable tools in circumferential groove 62 of seat 57 and prying the cartridge out of the manifold block cavity. Suction valve 88 is removed from valve cartridge 57 by depressing spring retaining ring 97 against spring 101 until snap ring 96 is free of the counterbore 99 in the retaining ring then removing the snap ring from fingers 94 and withdrawing suction valve 88 from seat bore 75. Discharge valve 82 is removed by removing snap ring 70 and sliding spring 87 and discharge valve 82 from the seat. All O-rings and backup rings can be easily removed and replaced.

While this invention has been described fully and completely with special emphasis upon a preferred embodiment, it should be understood that within the scope of the appended claims the invention may be practiced otherwise than as specifically described herein.

I claim:

1. In a high pressure reciprocating fluid pump including a pump drive housing having at least one reciprocating plunger extendable out of one end thereof;

a mounting plate secured to said drive housing plunger end having a first face perpendicular to the axis of said plunger in contact therewith and a second, parallel face with at least one bore extending therethrough in axial alignment with said plunger, stuffing box means releasably received in said mounting plate bore and having one end extending into said pump drive housing and a central bore slidably receiving one end of said plunger, packing means surrounding said plunger in reciprocal sealing relation a pressure chamber in said stuffing box means at the opposite end of said central bore coaxial with said plunger, suction and discharge manifold means comprising block means secured on said mounting plate second face and having at least one interior cavity substantially coaxial with said stuffing box means central bore and having suction and discharge manifolds therein opening into the end of said cavity opposite said plunger, and a unitary suction and discharge valve cartridge assembly in said manifold means interior cavity abutting said stuffing box means and aligned with said plunger and said pressure chamber, and including a suction valve and a discharge valve movably mounted on a common seat member to control fluid flow into and out of the end of said cavity.

2. A high pressure reciprocating fluid pump according to claim 1 in which;

said packing means comprises a packing assembly at the drive housing end of said bore surrounding said plunger in reciprocal sealing relation.

3. A high pressure reciprocating fluid pump according to claim 1 in which;

said pump drive housing has a plurality of reciprocating plungers extendable out of said one end;

said mounting plate has a plurality of bores extending therethrough in axial alignment one with each of said plungers, a plurality of said stuffing box means one in each of said mounting plate bores and each having an end extending into said pump drive housing and a central bore slidably receiving one end of one of said plungers, a plurality of said packing means one for each said plunger and surrounding the same reciprocal sealing relation a pressure chamber at the opposite end of each said stuffing box means bore coaxial with each said plunger, suction and discharge manifold means secured on said mounting plate second face and having a plurality of interior cavities coaxial with each said mounting plate bore, and a plurality of said suction and discharge valve cartridge assemblies one in each manifold means interior cavity.

4. A high pressure reciprocating fluid pump according to claim 1 in which;

said suction valve and said discharge valve are positioned concentric and radially spaced relative to one another on said common seat and coaxial with the plunger axis.

5. A high pressure reciprocating fluid pump according to claim 1 in which;

said mounting plate and said block means are hingedly connected together, said block means being movable for clear access to said stuffing box means and said suction and discharge valve cartridge assembly to permit removal of either as a unit independently of the other from said mounting plate said block means respectively for easy field maintenance.

6. A high pressure reciprocating fluid pump according to claim 1 in which;

said suction and discharge valve cartridge assembly is secured in said interior cavity by said stuffing box means when said block means is secured on said mounting plate in operative engagement therewith.

7. A high pressure reciprocating fluid pump according to claim 1 in which;

said common seat member of said suction and discharge valve cartridge assembly has diametral seals positioned in sealing engagement with said block means interior diametral cavity and the outward diametral cavity adjacent to said stuffing box means, said seal diameters being sized to create a differential hydraulic area between said seals and positioned to create a hydrostatic bias urging said suction and discharge valve cartridge assembly toward said stuffing box means from the fluid forces acting thereon during operation of the pump.

8. A high pressure reciprocating fluid pump according to claim 1 in which;

said suction and discharge valve cartridge assembly is mechanically biased in an interior cavity of said block means by the outward end of said stuffing box means when said block means is connected to said mounting plate.

9. A high pressure reciprocating fluid pump according to claim 1 in which;

said suction and discharge block means comprises a generally rectangular block having at least one cavity extending inwardly from one face for receiving said suction and discharge valve assembly means, a suction port extending inwardly from one side of said block, a discharge port extending inwardly from one side of said block, said cavity being in fluid communication with both said suction port and said discharge port, and said suction and discharge valves being operatively mounted on said common seat member within said cavity relative to said suction and discharge ports and to said pressure chamber to open and close fluid communication therethrough upon reciprocal movement of said plunger.

10. A high pressure reciprocating fluid pump according to claim 9 in which;

said mounting plate comprises a generally rectangular flange plate secured to the pump drive housing and having at least one cylindrical bore extending therethrough receiving said stuffing box means.

11. A high pressure reciprocating fluid pump according to claim 10 in which;

said manifold block has a plurality of bolt holes therethrough and said flange plate has a plurality of threaded holes aligned therewith for threadedly securing said manifold to said flange plate by bolts extending therethrough, and said manifold block and said flange plate being hingedly connected together along one adjacent edge for relative pivotal movement in the unbolted condition.

12. A high pressure reciprocating fluid pump according to claim 10 in which;

said bores in said flange plate have a flat on at least one side, and said stuffing box means has a corresponding flat on the exterior of the end received therein to prevent rotation thereof relative to said flange plate.

13. A high pressure reciprocating fluid pump according to claim 10 in which;

said rectangular block has at least one small bore extending from the exterior of one side of said block in normally closed fluid communication with said manifold cavity and with said flange plate bore to form a tell-tale fluid passageway which allows fluid to pass to the exterior of the manifold upon fluid leakage past said suction and discharge valve cartridge assembly to alert the pump operator of the leakage.

14. A high pressure reciprocating fluid pump according to claim 1 in which;

said packing means comprises at least one packing ring at the pump drive end and, the exterior diameter of said packing assembly being tapered relative to the longitudinal plunger axis.

15. A high pressure reciprocating fluid pump according to claim 1 in which;

said mounting plate has a counterbore in said second parallel face, said stuffing box means comprises a cylindrical member having a circumferential flange at one end slidably received within said mounting plate counterbore, a central longitudinal bore extending through said cylindrical member and tapered at the flanged end to form a pressure chamber which slidably receives one end of said plunger, an internally threaded diameter at the pump drive end of said cylindrical member longitudinal bore and an inwardly tapered packing bore extending between the threaded portion and the longitudinal bore and tapered inwardly relative to the longitudinal axis thereof, a tapered plunger packing assembly received in the tapered bore and comprising at least one packing ring, at the pump drive end, said packing assembly being tapered corresponding to the tapered bore, and having a central bore surrounding said plunger to form a reciprocal sealing relation therewith, a packing gland threadedly received in said internally threaded diameter having an exterior seal means to prevent fluid leakage around the threads and a central longitudinal bore surrounding said plunger, and a hollow cylindrical plunger guide bushing slidably received within said cylindrical member to surround and guide said plunger through said packing assembly to and serve as a backup for said packing ring.

16. A high pressure reciprocating fluid pump according to claim 15 in which;

said packing gland and said guide bushing have at least one lubricating passageway extending through the side wall of said packing gland and said guide bushing in axial alignment with a threaded hole through the side wall of said stuffing box for receiving packing lubrication from a lubricating source to lubricate said plunger.

17. A high pressure reciprocating fluid pump according to claim 15 in which;

said tapered outer diameter of said packing assembly is tapered at an angle sufficient to facilitate installation and removal of same and prevent the packing rings from traveling forward with the plunger on its discharge stroke, and said tapered packing configuration coacts with the fluid pressure during the plunger discharge stroke to urge said packing rings into the larger end of said tapered bore to compensate for packing ring wear.

18. A high pressure reciprocating fluid pump according to claim 9 in which;

said common seat member comprises a generally cylindrical member having a central bore extending therethrough in axial alignment with said pressure chamber, first seal means at one end surrounding said central bore and forming a sealing relation around said pressure chamber and second seal means at the opposite end forming a sealing relation around the manifold cavity suction port passageway, third and fourth seal means on the exterior of said seat member forming a sealing relation with the manifold cavity, said third and fourth seal means sized to provide a net differential hydraulic area therebetween in communication with the cavity discharge passageway, said net differential hydraulic area being of greater area than the facial area of said first seal means whereby said seat member is hydrostatically biased and urged toward said stuffing box means by the fluid pressure in said discharge port causing said first seal means to effect a seal on said stuffing box means surrounding said pressure chamber.

19. A high pressure reciprocating fluid pump according to claim 18 in which;

said common seat member has a suction valve seat surface at one end of its central bore and a discharge valve seat surface on its exterior diameter, a plurality of discharge passageways extending through said seat member between said seat central bore and said discharge valve seat surface in communication with said pressure chamber and said discharge port, said suction valve being movably mounted in said seat member central bore to engage said suction valve seat surface in sealing relation on the plunger discharge stroke and to allow communication through said seat member central bore on the plunger suction stroke, and said discharge valve being movably mounted on said seat member exterior diameter to engage said discharge seat surface in sealing relation closing off said discharge passageways on the plunger suction stroke and to allow communication through said discharge passageways on the plunger discharge stroke, a compression spring in said seat member normally urging said suction valve against the suction valve seat, and a compression spring on said seat member normally urging said discharge valve against the discharge valve seat.

20. A high pressure reciprocating fluid pump according to claim 19 in which;

said valve seat member comprises a generally cylindrical member having a first exterior diameter at one end, a second larger exterior diameter at the other end, and an outwardly tapered shoulder therebetween defining said discharge seat surface, an O-ring groove in each end face of said cylindrical member and O-ring seals therein defining said first and second seal means, an O-ring groove in said first diameter and an O-ring seal therein and a backup ring defining said third seal means, ana O-ring groove in said second diameter and an O-ring seal therein and a backup ring defining said fourth seal means.

21. A high pressure reciprocating fluid pump according to claim 20 in which;

said seat member central bore is counterbored at the larger diameter end to form a shoulder therebetween defining said suction valve seat surface, a counterbore in the first diameter end of said seat member for containing the suction valve spring, a circumferential groove in the small diameter of said seat member operatively supporting one end of said discharge valve spring, and a circumferential groove near the end of the second diameter to facilitate removal of said member by prying the cartridge out of the manifold block cavity.

22. A high pressure reciprocating fluid pump according to claim 21 in which;

said discharge valve comprises a ring-shaped member having a central bore and a counterbore slidable mounted on the first exterior diameter of said seat, the end surface of said discharge valve opposite the counterbore is tapered to form a sealing surface corresponding to said tapered discharge valve seat surface to form a fluid sealing relation therewith, and said discharge valve spring is received on the first exterior diameter of said seat with one end received in the discharge valve counterbore and its other end supported to urge said discharge valve to its closed position on the discharge seat surface.

23. A high pressure reciprocating fluid pump according to claim 21 in which;

said suction valve seat surface of said seat member is a spherical shoulder, said suction valve member comprises a generally cylindrical member having a first smaller diameter portion slidably received within the central bore of said seat member with an enlarged diameter at one end and a spherical shoulder therebetween to form a sealing surface to engage the suction valve seat of said member in a metal-to-metal sealing relation, said first or smaller diameter has longitudinally extending inwardly curved portions which form a plurality of suction fluid flow paths and circumferentially spaced guide wings therebetween, said guide wings extending longitudinally beyond said inwardly curved portions to form circumferentially spaced fingers, a snap ring groove in the circumference of the fingers near their ends and a snap ring therein, a thin cylindrical member having a central bore counterbored at one end slidably received on the outer diameter of said fingers and a circumferential flange at the counterbored end, and said suction valve spring surrounding said fingers and having one end received in said retaining ring counterbore and its other end engaging said circumferential flange to normally urge the suction valve to its closed position with its sealing surface against the seating surface of said seat member, whereby said suction valve is slidably contained within said valve seat and opens to allow fluid to be drawn from the manifold suction port and into the stuffing box pressure chamber on the plunger suction stroke and said suction valve spring urges said suction valve closed upon the plunger reaching the end of the suction stroke.

24. A high pressure reciprocating fluid pump according to claim 21 in which;

said suction valve seat surface of said seat member is a tapered shoulder, said suction valve member comprises a generally cylindrical member having a first smaller diameter portion slidably received within the central bore of said seat member with an enlarged diameter at one end and a tapered shoulder therebetween to form a sealing surface to engage the suction valve seat of said seat member in a metal-to-metal sealing relation, said tapered shoulder being tapered at an angle of from 45° to 75° relative to the longitudinal valve axis, said first smaller diameter having longitudinally extending inwardly curved portions which form a plurality of suction fluid flow paths and circumferentially spaced guide wings therebetween, said guide wings extending longitudinally beyond said inwardly curved portions to form circumferentially spaced fingers, a snap ring groove in the circumference of the fingers near their ends and a snap ring therein, a retaining ring member having a central bore counterbored at one end slidably received on the outer diameter of said fingers and a circumferential flange at the counterbored end, and said suction valve spring surrounding said fingers and having one end received in the retaining ring counterbore and its other end engaging the circumferential flange to normally urge the suction valve to its closed position with its sealing surface against the seating surface of said seat member, whereby said suction valve is slidably contained within said valve seat and opens to allow fluid to be drawn from the manifold suction port and into the stuffing box pressure chamber on the plunger suction stroke and said suction valve spring urges said suction valve closed upon the plunger reaching the end of the suction stroke.

25. A high pressure reciprocating fluid pump according to claim 21 in which;

said suction valve seat surface of said seat member is a flat shoulder, said suction valve member comprises a generally cylindrical member having a first smaller diameter portion slidably received within the central bore of said seat member with an enlarged diameter at one end and a flat shoulder therebetween to form a sealing surface to engage the suction valve seat of said seat member in a metal-to-metal sealing relation, said first smaller diameter having longitudinally extending inwardly curved portions which form a plurality of suction fluid flow paths and circumferentially spaced guide wings therebetween, said guide wings extending longitudinally beyond said inwardly curved portions to form circumferentially spaced fingers, a snap ring groove in the circumference of the fingers near their ends and a snap ring therein, a thin cylindrical member having a central bore counterbored at one end slidably received on the outer diameter of said fingers and a circumferential flange at the counterbored end, and said suction valve spring surrounding said fingers and having one end received in the retaining ring counterbore and its other end engaging the circumferential flange to normally urge the suction valve to its closed position with its sealing surface against the seating surface of said seat member, whereby said suction valve is slidably contained within said valve seat and opens to allow fluid to be drawn from the manifold suction port and into the stuffing box pressure chamber on the plunger suction stroke and said suction valve spring urges said suction valve closed upon the plunger reaching the end of the suction stroke.

26. A hinged manifold apparatus for installation on a high pressure reciprocating fluid pump having a pump drive housing and at least one reciprocating plunger;

a mounting plate having securing means for releasably securing the same to the plunger end of said drive housing having a first face in contact therewith and a second face parallel to the first face and at least one bore extending therethrough for receiving stuffing box means in axial alignment with said plunger, and a suction and discharge manifold block connected to said mounting plate and having a first face in contact with said mounting plate second face and at least one interior cavity formed in the first face coaxial with each said adapter flange bore for receiving suction and discharge valve means, said mounting plate and said manifold block being hinged together such that said manifold block may be pivoted relative thereto for clear access to said stuffing box means and said suction and discharge valve means when received in said bores and said cavities respectively, whereby either said stuffing box means or said suction and discharge valve means may be removed independently of the other from said adapter flange and said manifold block respectively for easy field maintenance.

27. A hinged manifold apparatus according to claim 26 in which;

said suction and discharge manifold block comprises a generally rectangular block having at least one cavity extending inwardly from said first face for receiving suction and discharge valve means, a suction port extends inwardly from one side of said manifold block, a discharge port extends inwardly from one side of said manifold block, and said block cavity being in fluid communication with both the said suction port and said discharge port.

28. A hinged manifold apparatus according to claim 27 in which;

said mounting plate comprises a generally rectangular flange plate having bolt holes therethrough and bolts securing it to the pump drive housing and having at least one cylindrical bore extending therethrough for receiving stuffing box means.

29. A hinged manifold apparatus according to claim 27 in which;

said manifold block having a plurality of bolt holes and said flange plate having a plurality of threaded holes aligned therewith for securing said manifold block to said flange plate and bolts threadedly extending through said bolt holes.

30. A hinged manifold apparatus according to claim 28 in which;

said bores in said flange plate each have a flat on at least one side corresponding to a flat on the stuffing box means to prevent rotation of the stuffing box means relative to said flange plate when installed therein.

31. A hinged manifold apparatus according to claim 28 in which;

said manifold block has at least one small bore extending from the exterior of one side in normally closed fluid communication with each said manifold cavity and with said flange plate bore to form a telltale fluid passageway allowing fluid to pass to the exterior of the manifold upon fluid leakage past the suction and discharge valve means to alert the pump operator of the leakage.

32. Stuffing box apparatus for installation in a high pressure reciprocating fluid pump having a pump drive housing and at least one reciprocating plunger;

a generally cylindrical stuffing box housing having a circumferential flange at one end for facilitating installation within a counterbore, a central longitudinal bore extending through the cylindrical housing and tapered at the flanged end to form a pressure chamber which slidably receives one end of said plunger, a packing cavity at the opposite end of the central bore from said pressure chamber, an internally threaded diameter at the pump drive end of said longitudinal bore and an inwardly tapered packing bore extending between the threaded portion and the longitudinal bore and tapered inwardly relative to the longitudinal axis, a tapered plunger packing assembly received in the tapered bore and comprising at least one packing ring at the pump drive end, said packing assembly tapered corresponding to the tapered bore, and having a central bore surrounding said plunger to form a reciprocal sealing relation therewith, a packing gland threadedly received in the internally threaded diameter having an exterior seal means to prevent fluid leakage around the threads and a central longitudinal bore surrounding said plunger, and a hollow cylindrical plunger guide bushing slidably received within said bore to surround and guide said plunger through said packing assembly to and serve as a backup for the packing adapter ring.

33. Stuffing box apparatus according to claim 32 including;

at least one lubricating passageway extending through the side wall of said packing gland and said guide bushing in axial alignment with a threaded hole through the side wall of said stuffing box housing for receiving packing lubrication from a lubricating source to lubricate said plunger.

34. Stuffing box apparatus according to claim 32 in which;

said tapered outer diameter of said packing assembly tapered at an angle sufficient to facilitate installation and removal of same and prevent the packing rings from traveling forward with the plunger on its discharge stroke, and said tapered packing configuration coacting with the fluid pressure during the plunger discharge stroke to urge said packing rings into the larger end of said tapered bore to compensate for packing ring wear.

35. A suction and discharge valve cartridge assembly for installation in a valve manifold apparatus having at least one valve cavity in communication with suction and discharge port passageways and the manifold apparatus of the type used in a high pressure reciprocating fluid pump having a pump drive housing and at least one reciprocating plunger extending through stuffing box means, the valve cartridge assembly comprising;

a generally cylindrical seat member having a central bore extending therethrough, a suction valve seat surface and a discharge valve seat surface concentric and radially spaced relative to one another, a suction valve member and a discharge valve member movably mounted on said seat member relative to said suction valve seat surface and said discharge valve seat surface respectively, said suction valve and said discharge valve members positioned concentric and radially spaced relative to one another on said seat member and coaxial with the seat axis, and said suction valve having a surface opposite said seat surface substantially coplanar with one end of said cylindrical seat member.

36. A valve cartridge assembly according to claim 40 including;

first seal means at one end surrounding said central bore and forming a sealing relation around the plunger pressure chamber of said pump and second seal means at the opposite end forming a sealing relation around a suction port passageway in the manifold apparatus, third and fourth seal means on the exterior of said seat member forming a sealing relation with a valve cavity in the manifold apparatus, said third and fourth seal means sized to provide a net differential hydraulic area therebetween in communication with a discharge passageway in the manifold apparatus, said net differential hydraulic area being of greater area than the facial area of said first seal means whereby said seat member is hydrostatically biased and urged toward the pump stuffing box means by the fluid pressure in the discharge port causing said first seal means to effect a seal on said stuffing box means surrounding said pressure chamber.

37. A valve cartridge assembly according to claim 40 in which;

said suction valve seat surface is disposed at one end of said central bore and said discharge valve seat surface is disposed on the exterior of said seat member, a plurality of discharge passageways extending through said seat member between said seat central bore and said discharge valve seat surface for fluid communication between the pump pressure chamber and said discharge port, said suction valve movably mounted in said seat member central bore to engage said suction valve seat surface in sealing relation on the plunger discharge stroke and to allow communication through said seat member central bore on the plunger suction stroke, and said discharge valve movably mounted on said seat member exterior diameter to engage said discharge seat surface in sealing relation closing off said discharge passageways on the plunger suction stroke and to allow communication through said discharge passageways on the plunger discharge stroke, a compression spring in said seat member normally urging said suction valve against the suction valve seat, and a compression spring on said seat member normally urging said discharge valve against the discharge valve seat.

38. A valve cartridge assembly according to claim 37 in which;

said valve seat member comprises a generally cylindrical member having a first exterior diameter at one end, a second larger exterior diameter at the other end, and an outwardly tapered shoulder therebetween defining said discharge seat surface, an O-ring groove in each end face of said cylindrical member O-ring seals therein defining a first and second seal means, an O-ring groove in said first diameter, an O-ring seal and a backup ring therein defining a third seal means, an O-ring groove in said second diameter, an O-ring seal and a backup ring therein defining a fourth seal means.

39. A valve cartridge assembly according to claim 38 in which;

said seat member central bore is counterbored at the larger diameter end to form a shoulder therebetween defining said suction valve seat surface, a counterbore in the first diameter end of said seat member for containing the suction valve spring, a circumferential groove in the a small diameter of said seat member operatively supporting one end of said discharge valve spring, and a circumferential groove near the end of the second diameter to facilitate removal of said seat member by prying the cartridge out of the manifold cavity.

40. A valve cartridge assembly according to claim 39 in which;

said discharge valve comprises a ring-shaped member having a central bore and a counterbore slidably mounted on the first exterior diameter of said seat, the end surface of said discharge valve opposite the counterbore is tapered to form a sealing surface corresponding to said tapered discharge valve seat surface to form a fluid sealing relation therewith, and said discharge valve spring is received on the first exterior diameter of said seat with one end received in the discharge valve counterbore and its other end supported to urge said discharge valve to its closed position of the discharge seat surface.

41. A valve cartridge assembly according to claim 39 in which;

said suction valve seat surface of said seat member is a spherical shoulder, said suction valve member comprises a generally cylindrical member having a first smaller diameter portion slidably received within the central bore of said seat member with an enlarged diameter at one end and a spherical shoulder therebetween to form a sealing surface to engage the suction valve seat of said seat member in a metal-to-metal sealing relation, said first or smaller diameter has longitudinally extending inwardly curved portions which form a plurality of suction fluid flow paths and circumferentially spaced guide wings therebetween, said guide wings extend longitudinally beyond said inwardly curved portions to form circumferentially spaced fingers, a snap ring groove in the circumference of the fingers near their ends and a snap ring therein, a retaining ring having a central bore counterbored at one end slidably received on the outer diameter of said fingers and a circumferential flange at the counterbored end, and said suction valve spring surrounding said fingers and having one end received in the retaining ring counterbore and its other end engaging the circumferential flange to normally urge the suction valve to its closed position with its sealing surface against the seating surface of said seat member, whereby said suction valve is slidably contained within said valve seat and opens to allow fluid to be drawn from the manifold suction port and into the stuffing box pressure chamber on the plunger suction stroke and said suction valve spring urges said suction valve closed upon the plunger reaching the end of the suction stroke.

42. A valve cartridge assembly according to claim 39 in which;

said suction valve seat surface of said seat member is a tapered shoulder, said suction valve member comprises a generally cylindrical member having a first smaller diameter portion slidably received with the central bore of said seat member with an enlarged diameter at one end and a tapered shoulder therebetween to form a sealing surface to engage the suction valve seat of said seat member in a metal-to-metal sealing relation, said tapered shoulder is tapered at an angle of from 45° to 75° relative to the longitudinal valve axis, said first smaller diameter has longitudinally extending inwardly curved portions which form a plurality of suction fluid flow paths and circumferentially spaced guide wings therebetween, said guide wings extend longitudinally beyond said inwardly curved portions to form circumferentially spaced fingers, a snap ring groove in the circumference of the fingers near their ends and a snap ring therein, a thin cylindrical member having a central bore counterbored at one end slidably received on the outer diameter of said fingers and a circumferential flange at the counterbored end, and said suction valve spring surrounding said fingers and having one end received in the retaining ring counterbore and its other end engaging the circumferential flange to normally urge the suction valve to its closed position with its sealing surface against the seating surface of said seat member, whereby said suction valve is slidably contained within said valve seat and opens to allow fluid to be drawn from the manifold suction port and into the stuffing box pressure chamber on the plunger suction stroke and said suction valve spring urges said suction valve closed upon the plunger reaching the end of the suction stroke.

43. A valve cartridge assembly according to claim 39 in which;

said suction valve seat surface of said seat member is a flat shoulder, said suction valve member comprises a generally cylindrical member having a first smaller diameter portion slidably received within the central bore of said seat member with an enlarged diameter at one end and a flat shoulder therebetween to form a sealing surface to engage the suction valve seat of said seat member in a metal-to-metal sealing relation, said first or smaller diameter has longitudinally extending inwardly curved portions which form a plurality of suction fluid flow paths and circumferentially spaced guide wings therebetween, said guide wings extend longitudinally beyond said inwardly curved portions to form circumferentially spaced fingers, a snap ring groove in the circumference of the fingers near their ends a snap ring therein, a retaining ring having a central bore counterbored at one end slidably received on the outer diameter of said ringers and a circumferential flange at the counterbored end, and said suction valve spring surrounding said fingers and having one end received in the retaining ring counterbore and its other end engaging the circumferential flange to normally urge the suction valve to its closed position with its sealing surface against the seating surface of said seat member, whereby said suction valve is slidably contained within said valve seat and opens to allow fluid to be drawn from the manifold suction port and into the stuffing box pressure chamber on the plunger suction stroke and said suction valve spring urges said suction valve closed upon the plunger reaching the end of the suction stroke.

* * * * *